US007299589B2

(12) United States Patent
Campbell et al.

(10) Patent No.: US 7,299,589 B2
(45) Date of Patent: Nov. 27, 2007

(54) TELESCOPING BOOM ACTUATION MECHANISM FORMED OF CONCENTRICALLY NESTED TUBULAR BOOM SECTIONS MUTUALLY ENGAGED BY ROLLER ASSEMBLIES RIDING ON HELICAL TRACKS

(75) Inventors: Thomas Bruce Campbell, Melbourne Beach, FL (US); Rick Harless, West Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 693 days.

(21) Appl. No.: 10/691,325

(22) Filed: Oct. 22, 2003

(65) Prior Publication Data

US 2005/0097833 A1 May 12, 2005

(51) Int. Cl.
*E04H 12/34* (2006.01)
*B66C 23/00* (2006.01)

(52) U.S. Cl. ..... 52/118; 52/114; 52/117; 52/121; 198/778; 198/779; 198/780; 198/781; 193/35 R; 193/37; 193/35 S; 212/284; 212/200; 212/347

(58) Field of Classification Search ..... 52/111, 52/114, 117, 118, 121; 212/284, 200, 347; 198/778, 779, 780, 781, 781.01; 193/35 R, 193/37, 35 S See application file for complete search history.

(56) References Cited

U.S. PATENT DOCUMENTS

| | | | | | |
|---|---|---|---|---|---|
| 2,069,012 | A * | 1/1937 | Lynes | 254/102 |
| 4,100,707 | A * | 7/1978 | Kranefeld et al. | 52/115 |
| 5,035,094 | A * | 7/1991 | Legare | 52/118 |
| 5,062,245 | A * | 11/1991 | Dent | 52/118 |
| 5,101,215 | A * | 3/1992 | Creaser, Jr. | 343/883 |
| 5,249,396 | A * | 10/1993 | Zuse | 52/108 |
| 5,279,084 | A * | 1/1994 | Atsukawa | 52/118 |
| 5,315,795 | A | 5/1994 | Chae et al. | 52/113 |
| 5,351,809 | A * | 10/1994 | Gilmore et al. | 198/812 |
| 5,685,416 | A * | 11/1997 | Bonnet | 198/812 |
| 6,298,971 | B2 * | 10/2001 | Belz et al. | 193/35 S |
| 6,761,387 | B2 * | 7/2004 | Sloss | 296/3 |
| 6,935,487 | B2 * | 8/2005 | Schaum et al. | 198/812 |

* cited by examiner

*Primary Examiner*—Jeanette Chapman
(74) *Attorney, Agent, or Firm*—Allen, Dyer, Doppelt, Milbrath & Gilchrist, P.A.

(57) ABSTRACT

A telescoping boom mechanism for deploying an expandable structure, such a hoop-supported antenna, comprises a plurality of concentrically nestable tubular boom sections, that are mutually engageable with one another by way of roller assemblies and helical tracks formed thereon. The tubular boom sections are caused to telescopically expand or retract along a deployment axis by means of a rotational drive motor coupled to an outermost one of the tubular boom sections.

12 Claims, 6 Drawing Sheets

TELESCOPING BOOM ACTUATION MECHANISM FORMED OF CONCENTRICALLY NESTED TUBULAR BOOM SECTIONS MUTUALLY ENGAGED BY ROLLER ASSEMBLIES RIDING ON HELICAL TRACKS

FIELD OF THE INVENTION

The present invention relates to expandable structure-deploying actuator mechanisms, such as those used for deploying spacecraft-stowed antenna structures and the like, such as a hoop supported antenna, and is particularly directed to a telescoping boom mechanism which, in its stowed configuration, comprises a plurality of concentrically nested tubular sections. These tubular sections are mutually engageable by way of helical tracks formed thereon, so that the tubular sections may expand telescopically along a deployment axis by means of a rotational drive actuator coupled to one of the tubular sections.

BACKGROUND OF THE INVENTION

One of the important characteristics desired of a space-deployable structure, such as, but not limited to, communication satellites and associated antenna structures that are transported aboard a space-launch vehicle, is that the structure be as lightweight and stowable in as compact as possible configuration. While a variety of deployment architectures have been proposed to date, telescoping boom designs are particularly attractive because of their highly 'nested' stowing capability. Currently, the most common telescoping boom deployment mechanisms are cable drive-based and lead screw-based mechanisms.

In the former mechanism, a cable, or series of cables, are routed between nesting boom sections in a manner that, when wound, the boom sections will tend to expand. Drawbacks to this approach include the necessity of a mechanism that insures that the spooling cable does not tangle, and the fact that the extension force is not along the axis of the boom, which results in a high risk of binding. In lead screw-based designs, a series of boom sections, each with its own nut element, are deployed through the sequenced engagement and disengagement of the nut elements. Such an approach requires a sequencing mechanism to engage the nuts in a precisely synchronized manner, in addition, the engaging nuts must be properly configured to prevent 'cross-threading'.

SUMMARY OF THE INVENTION

In accordance with the present invention, shortcomings of conventional telescoping boom designs, including those described above, are substantially mitigated by means of a 'nested helix-based' telescoping boom architecture. As will be described, the invention is configured of a plurality of concentrically nestable tubular boom sections, that are mutually engageable via helical tracks formed on their outer cylindrical surfaces and associated rollers formed on their inner surfaces. Except for the outermost or largest diameter boom section, and the innermost or smallest diameter boom section, each tubular boom section has both a helical track in the form of a helical ridge extending along its outer cylindrical surface and upper and lower roller assemblies at an interior surface portion thereof. The outermost tubular boom section contains interior roller assemblies but no exterior helical track; conversely, the innermost boom section contains no interior roller assemblies, but does contain an outer helical track. The interior roller assemblies of a relatively outer tubular boom section are arranged to tangentially engage opposite sides of the helical track of an adjacent, relatively interior tubular boom section. In response to rotation of the relatively outer tubular boom section and thereby its roller assemblies, the helix of the relatively interior tubular boom section translates that rotational force into an axial displacement of the relatively interior tubular boom section.

Pursuant to a non-limiting embodiment, the rotational force is supplied by way of an electrical motor, having its output shaft driving a spur gear that engages an internal ring gear affixed to the base end of the outermost tubular boom section. When the electric motor is energized to expand the boom, rotation of the outermost tubular boom section in a first direction causes its 'lower' interior roller assembly to be rotationally urged against the underside of the helical track on the outer cylindrical surface of the next-to-outermost tubular boom section. This action is translated by the helical track into outward linear displacement of the next-to-outermost tubular boom section along the common displacement axis.

As the lower roller assembly of the outermost tubular boom section continues to rotate, and thereby axially displace the next to outermost tubular boom section, the upper roller assembly eventually encounters a stop element in the upper edge of the helical track of the next to the outermost tubular boom section. This stop element prevents further axial displacement of the next-to-outermost tubular boom section, and causes the next-to-outermost tubular boom section to begin rotating in unison with the outermost tubular boom section. With the next-to-outermost tubular boom section rotating in unison with the outermost tubular boom section, the lower roller assembly of the next to outermost tubular boom section is urged against the underside of the helical track of the next interior tubular boom section, so as to cause linear displacement of that tubular boom section along the displacement axis. This roller assembly-based axial displacement of the respective boom sections continues until the motor is de-energized or until all of the boom sections have been fully deployed. Once the tubular boom sections have been deployed to their full telescopic extension, a cut-off switch is tripped to terminate further energization of the motor.

In order to retract the tubular boom sections into their nested configuration, the electrical drive to the DC motor is reversed from that used to expand the boom sections to their fully deployed condition. This operation of the motor causes the 'upper' roller assembly of the outermost tubular boom section to be urged against the top surface of the helical track of the next-to-outermost boom section, so as to effect downward or retracting linear displacement of the next-to-outermost tubular boom section along the common displacement axis. Namely, the retraction operation proceeds in the same manner as the expansion operation, except that it is now the upper roller assembly of a respective boom section that is acting upon the top surface of the helical track of an adjacent boom, so as to cause retraction of that adjacent boom. As a respective boom is retracted to its nested position it stops translating along the displacement axis and starts rotating so as to cause displacement of an adjacent, relatively radially interior boom section. In a complementary manner to the expansion operation, once all the boom sections have been fully retracted, an associated limit switch de-energizes the electric motor to terminate the retraction operation.

DETAILED DESCRIPTION

Figure 1:
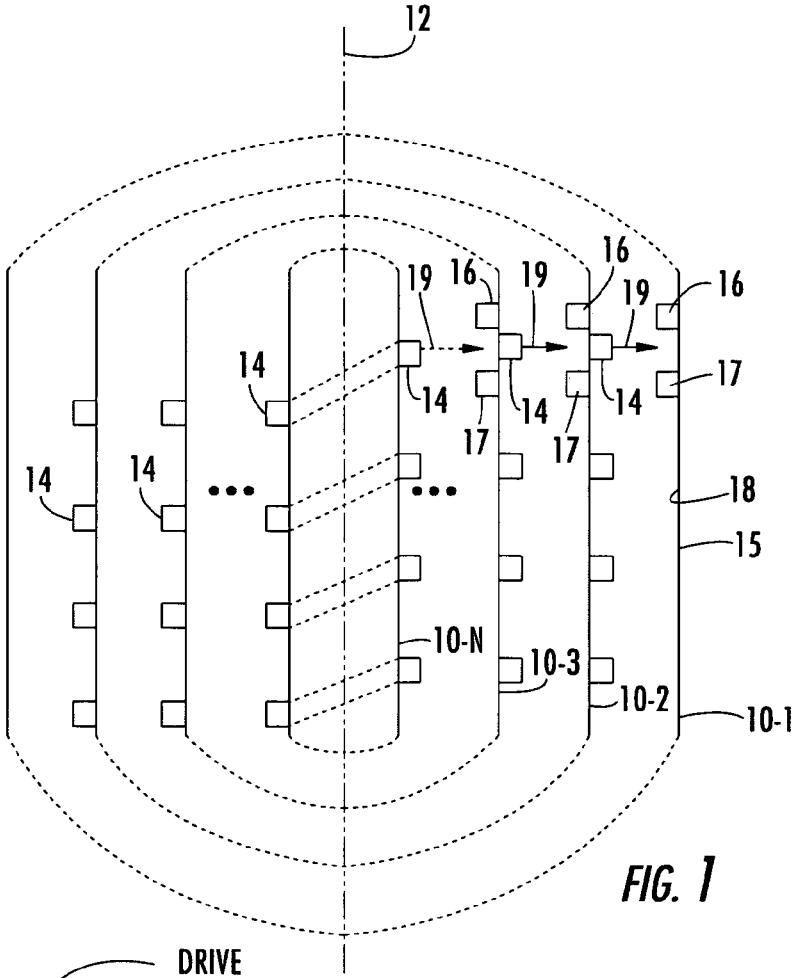
FIG. 1 is a reduced complexity diagrammatic illustration of the nested configuration of the telescoping boom in accordance with the present invention.
Figure 2:
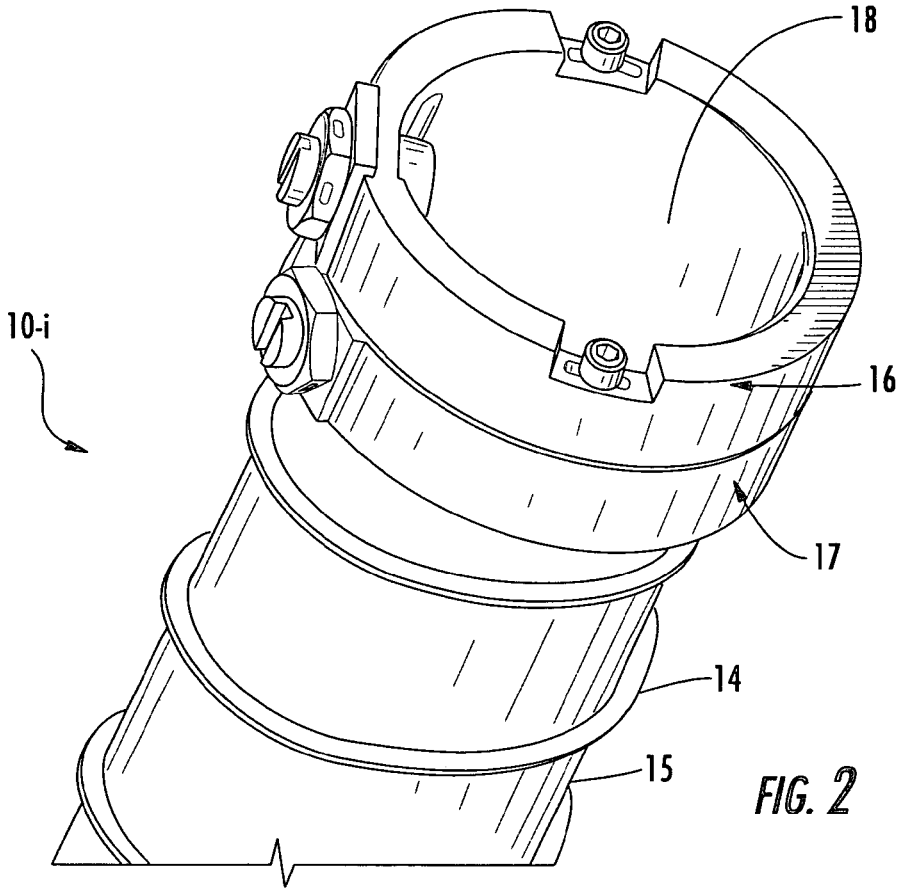
FIG. 2 is a partial perspective view of a respective tubular boom section of the telescoping boom of the invention.

Attention is initially directed to FIG. 1, which is a reduced complexity diagrammatic illustration of the nested configuration of the telescoping boom in accordance with the present invention. As shown therein, the boom is comprised of a plurality of N generally tubular boom sections 10-1, 10-2, 10-3, . . . , 10-N (four being shown in the illustrated example), that are concentric about a common displacement axis 12, along which the tubular boom sections are mutually displaced in the course of the deployment of the boom. Except for the outermost (largest diameter) boom section 10-1, and the innermost (smallest diameter) boom section 10-N, each boom section, a partial perspective view of which is shown in FIG. 2, has both a helical track 14 in the form of a helical ridge extending along its outer cylindrical surface 15, and a plurality of roller assemblies 16 and 17 at an interior surface portion 18 thereof.

Figure 3:
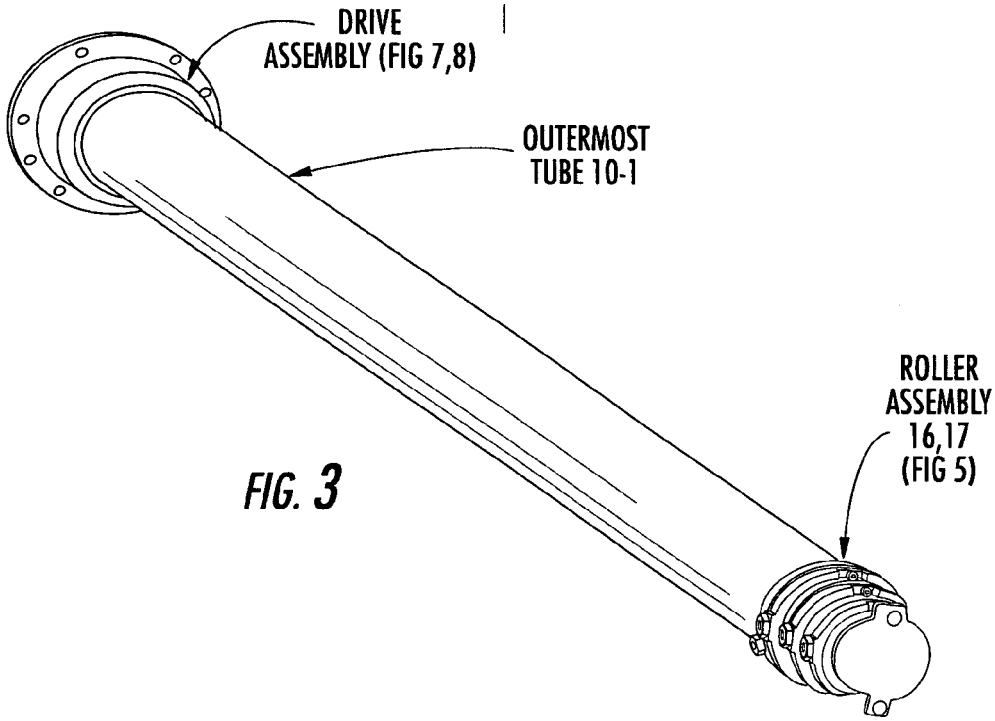
FIG. 3 is a perspective view of the nesting of coaxially adjacent tubular boom sections of the telescoping boom of the present invention.
Figure 4:
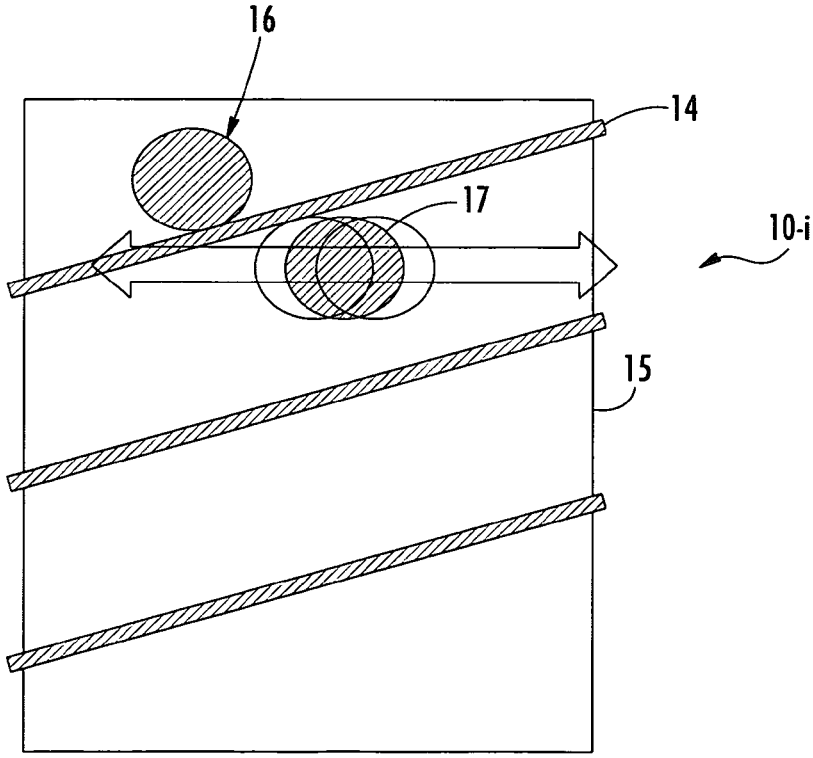
FIG. 4 is a diagrammatic side view of FIG. 2 of a pair of interior roller assemblies adjacent to opposite surfaces of a helical track of a tubular boom section of the invention.

As shown in FIG. 1 and further depicted in the perspective nested view of FIG. 3, the outermost tubular boom section 10-1 contains no exterior helical track, but does contain a plurality of interior roller assemblies 16 and 17 at its interior surface portion 18. In a complementary manner, the innermost boom section 10-N contains no interior roller assemblies, but does contain a helical track 14. As indicated by the arrows 19 in FIG. 1, and as depicted in the diagrammatic side view of FIG. 4, the plurality of interior roller assemblies 16, 17 of a relatively outer tubular boom section, such as those of the outermost tubular boom section 10-1, are arranged to tangentially engage opposite sides of the helical track 14 of an adjacent, relatively interior tubular boom section, such as the tubular boom section 10-2. As will be described below with reference to FIG. 9, the helical track of a respective tubular boom section includes a stop element (shown at 98 in FIG. 9) that prevents further axial displacement of that tubular boom section relative to the adjacent tubular boom section whose roller assemblies are urged against its helical track.

Figure 5:
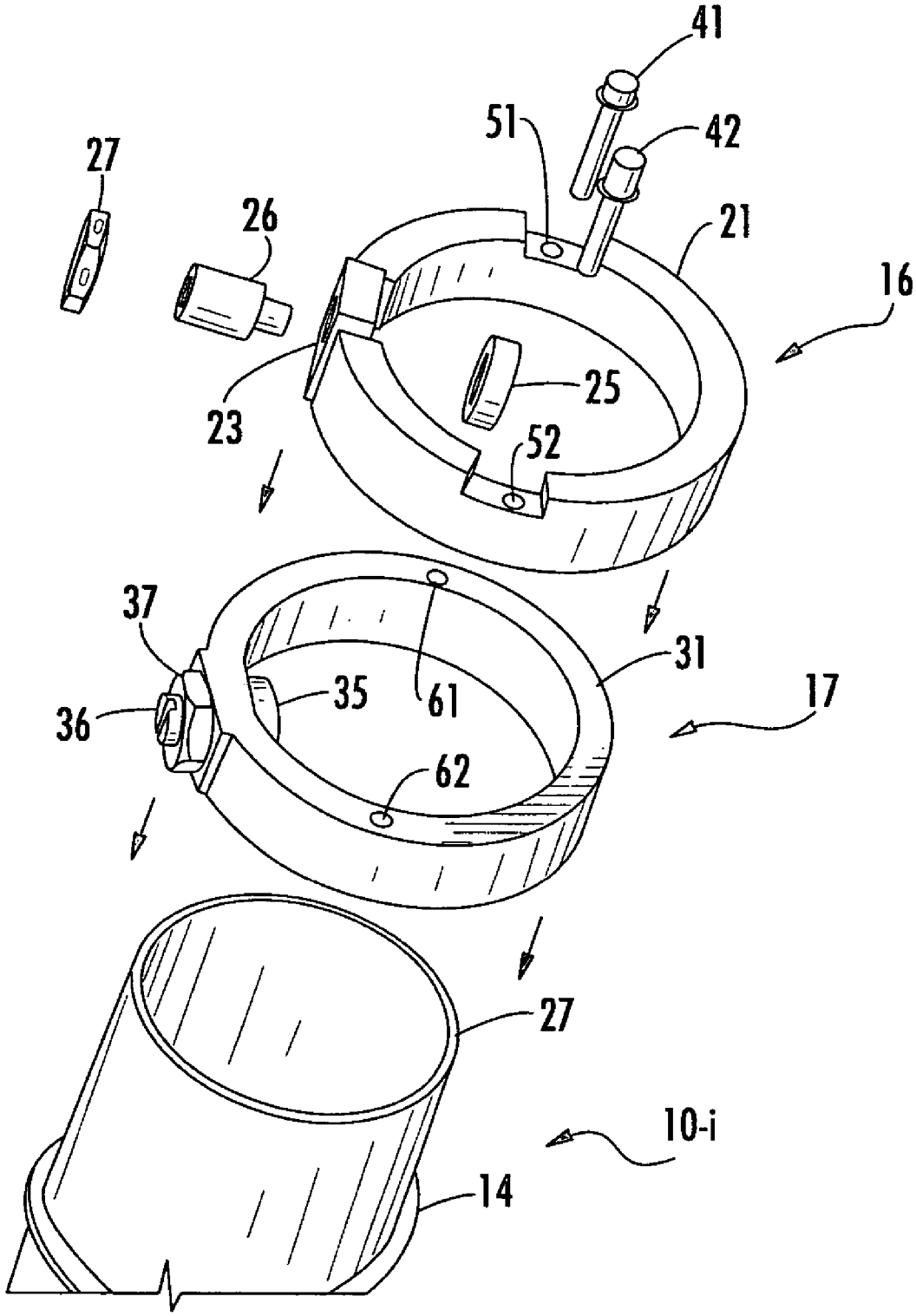
FIG. 5 is a partially exploded perspective view of a respective tubular boom section of the telescoping boom of the invention.
Figure 6:
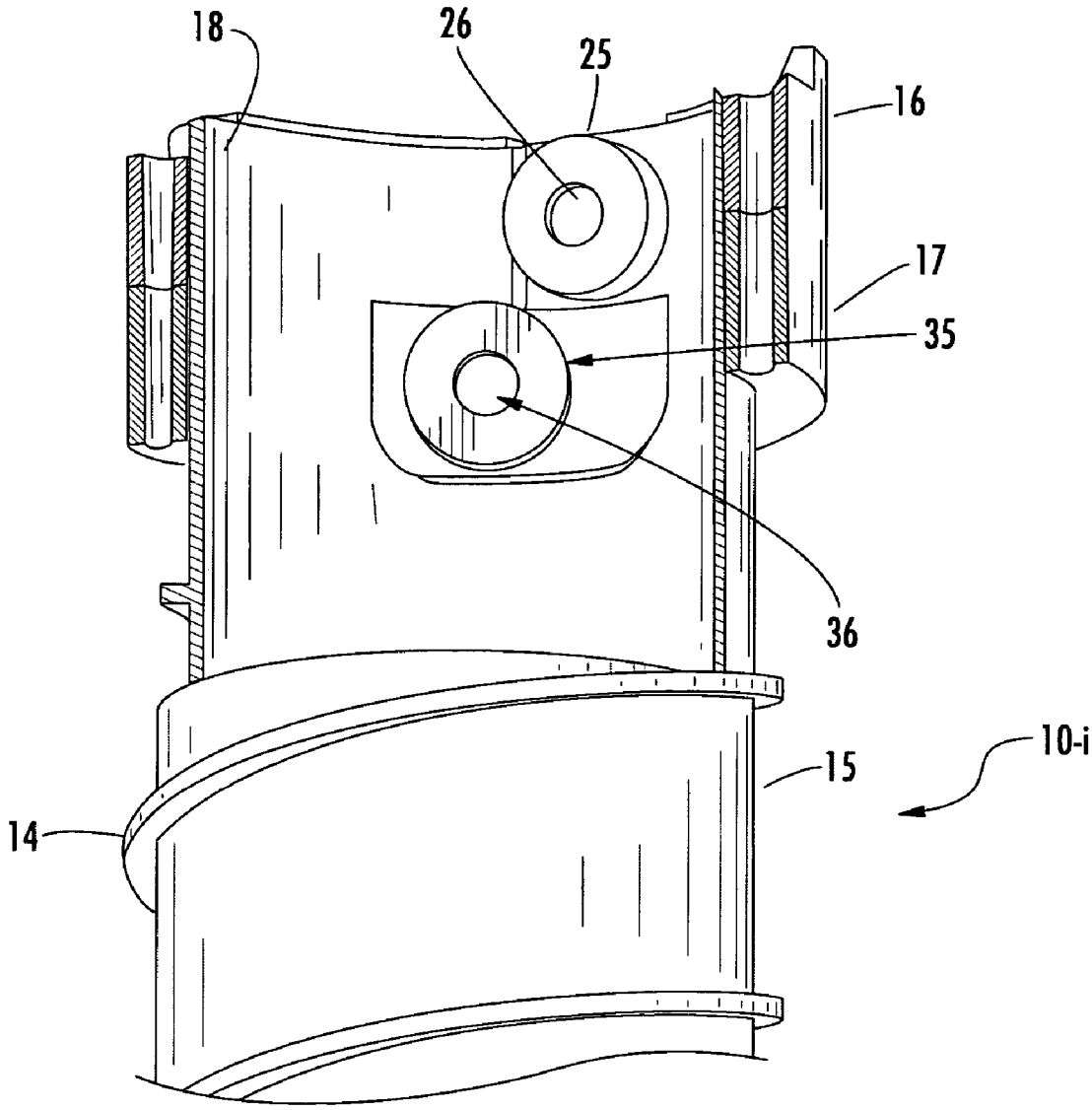
FIG. 6 is a partial cut-away view of a respective tubular boom section of the telescoping boom of the invention.

The configuration of, and the manner in which the roller assemblies 16, 17 are attached to, a respective tubular boom section 10 are shown in FIG. 3, the partially exploded perspective view of FIG. 5, and the partial cut-away view of FIG. 6. In particular, the upper roller assembly 16 is shown as comprising a ring member 21 having a radial bore 23 that is sized to retain a ball bearing-supported roller or wheel element 25 that is press fit onto an axial support element 26. A lock nut 27 is used to secure the roller bearing in a fixed position. The ring member 21 is bonded to a distal end portion 27 of the tubular boom section 10. Adjacent to the upper roller assembly 16 is a lower roller assembly 17 shown as comprising a ring member 31 having a radial slot that is sized to retain a ball bearing supported roller or wheel element 35, held by axial support element 36 while providing a limited amount of play to provide for adjustment of the lower roller element 17 relative to the upper roller assembly. A lock nut 37 is used to secure the lower roller in a fixed position. The lower roller assembly 17 is held in place by a pair of screws 41, 42 that pass through bores 51, 52 in the upper ring 21 and are screwed into threaded bores 61, 62 of the lower ring 31.

Figure 7:
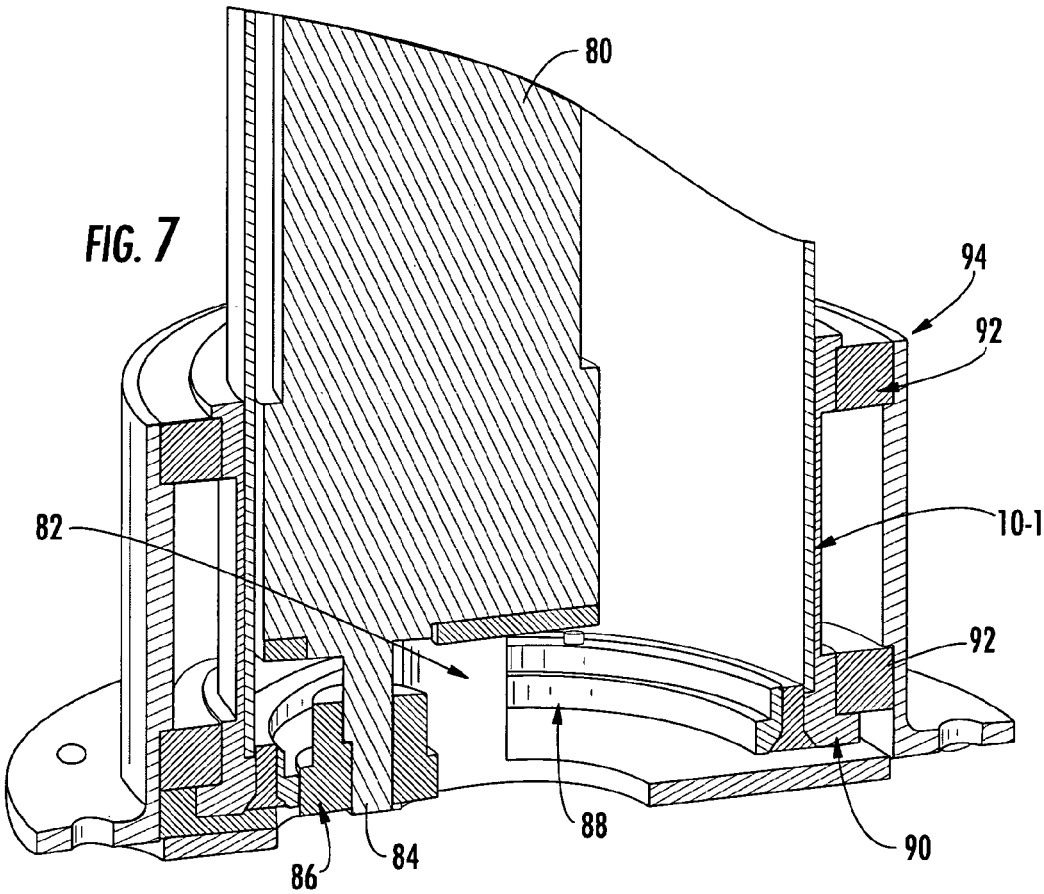
FIGS. 7 and 8 are respective partial cutaway perspective views of the electrical motor-based actuator mechanism for the telescopic boom of the invention.
Figure 8:
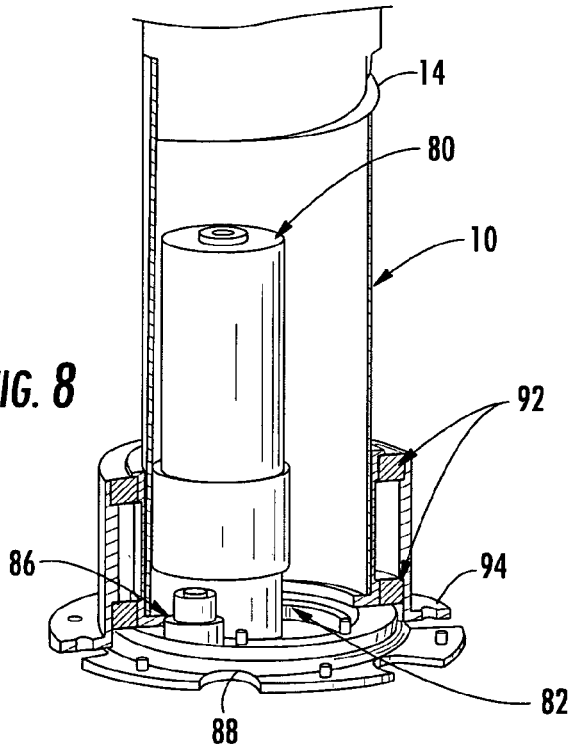

FIGS. 7 and 8 are respective partial cutaway perspective views of the electrical motor-based actuator mechanism for the telescopic boom of the invention. As shown therein, a DC electric motor 80 is supported by a mounting bracket 82 at a base or terminal end portion of the boom assembly. Motor 80 has an output shaft 84 upon which is mounted a spur gear 86. The spur gear 86 engages an internal ring gear 88, which affixed to the base end 90 of the outermost tubular boom section 10-1. Outermost tubular boom section 10-1 is rotationally supported by a dual ball bearing mount 92 to a support housing 94.

It should be noted that the sequence of the deployment is not necessarily from outermost segment to innermost segment. The actual sequence of deployment will be determined by other forces, such as friction or the mechanical advantage provided by the slopes of the helical threads. In other words the section that takes the least amount of torque to rotate will translate first. However, for the purposes of providing a non-limiting example, it will be assumed that the forces acting on the various sections allow for deployment from the outermost section to the innermost section, without a loss in generality. Moreover, it should be pointed out that the structure being deployed is required to react torque through the innermost section. If the innermost tube is not held against rotation, the assembly will not translate.

When the electric motor 80 energized to expand the boom, the rotation of its output shaft 84 in a first rotational direction and the spur gear 86 affixed thereto causes rotation of the ring gear 88. Since the ring gear 88 is solid with the base end of the outermost tubular boom section 10-1, this operation of the motor causes rotation of the outermost tubular boom section 10-1 in the dual ball bearing mount 92. As the outermost tubular boom section 10-1 rotates in the boom expanding direction, its lower roller assembly 17 is rotationally urged against the underside of the helical track 14 of the next-to-outermost tubular boom section 10-2. This action of the lower roller assembly 17 against the underside of the helical track 14 of the next-to-outermost tubular boom section 10-2 is translated by the helical track into outward linear displacement of the next-to-outermost tubular boom section 10-2 along the common displacement axis 12.

Figure 9:
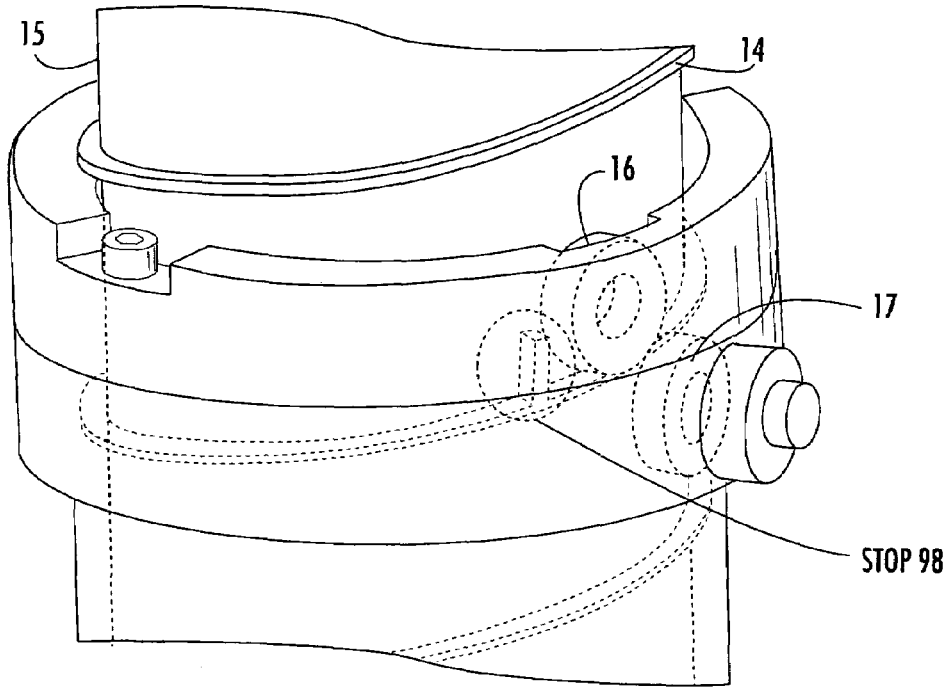
FIG. 9 shows a stop element formed in a helical track of a respective tubular boom section of the telescoping boom of the invention.

As shown in FIG. 9, as the lower roller assembly 17 of the outermost tubular boom section 10-1 continues to rotate, and cause axial displacement of the next to outermost tubular boom section 10-2, the upper roller assembly 16 eventually encounters a stop element 98 in the upper edge of the helical track 14 of the next to the outermost tubular boom section

10-2. As pointed out above, this stop element prevents further axial displacement of the next-to-outermost tubular boom section 10-2, and causes the next-to-outermost tubular boom section 10-2 to begin rotating in unison with the outermost tubular boom section 10-1.

Figure 10:
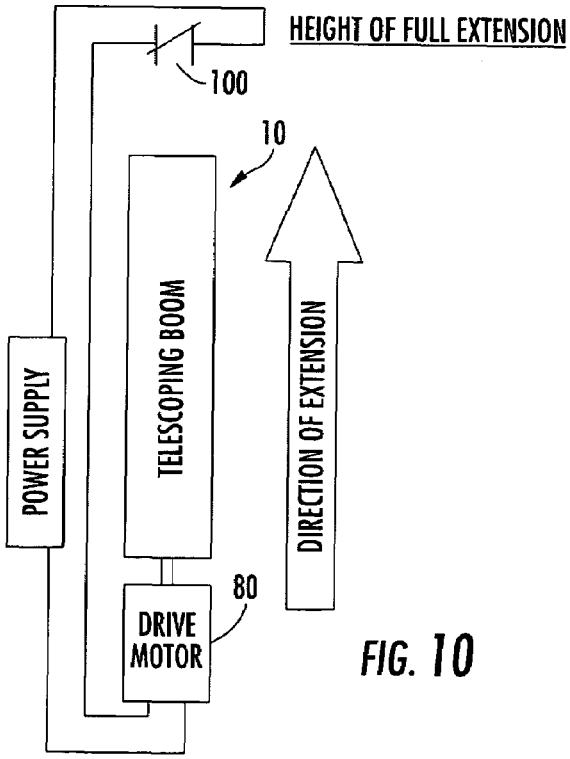
FIG. 10 is a schematic block diagram of the telescoping boom in accordance with the present invention.

With the next-to-outermost tubular boom section 10-2 rotating in unison with the outermost tubular boom section 10-1, the lower roller assembly 17 of the next to outermost tubular boom section is urged against the underside of the helical track 14 of the next interior tubular boom section 10-3, so as to cause linear displacement of that tubular boom section along the common displacement axis 12. The roller assembly-based axial displacement of the respective boom sections described above continues until the motor is de-energized or until all of the boom sections have been fully deployed. Once the tubular boom sections have been deployed to their full telescopic extension, a cut-off switch shown at 100 in the schematic diagram of FIG. 10 is tripped to terminate further energization of the motor.

In order to retract the tubular boom sections into their nested configuration shown in FIGS. 1 and 2, the electrical drive to the DC motor 80 is reversed from that used to expand the boom sections to their fully deployed condition, described above. This operation of the motor 80 causes the upper roller assembly 16 of the outermost tubular boom section 10-1 to be urged against the top surface of the helical track 14 of the next-to-outermost boom section 10-2, so as to effect downward or retracting linear displacement of the next-to-outermost tubular boom section 10-2 along the common displacement axis 12. Namely, the retraction operation proceeds in the same manner as the expansion operation, except that it is now the upper roller assembly 16 of a respective boom section that is acting upon the top surface of the helical track 14 of an adjacent boom, so as to cause retraction of that adjacent boom. Thus, as a respective boom is retracted to its nested position it stops translating along the displacement axis and starts rotating so as to cause displacement of an adjacent, relatively radially interior boom section. In a complementary manner to the expansion operation, once all the boom sections have been fully retracted, an associated limit switch de-energizes the electric motor to terminate the retraction operation.

As will be appreciated from the foregoing description, shortcomings of conventional telescoping boom architectures, including cable drive-based and lead screw-based mechanisms, referenced above, are effectively obviated by the nested helix-based telescoping boom mechanism of the invention. Using a reduced complexity spur gear—ring gear coupling arrangement, the helix based design of the invention enables the output drive of an electric motor to cause respective ones of a set of coaxial tubular boom sections to be linearly displaced when rotationally driven until all of the boom sections have been fully expanded/retracted.

While we have shown and described an embodiment in accordance with the present invention, it is to be understood that the same is not limited thereto but is susceptible to numerous changes and modifications as known to a person skilled in the art. We therefore do not wish to be limited to the details shown and described herein, but intend to cover all such changes and modifications as are obvious to one of ordinary skill in the art.

What is claimed:

1. A telescoping boom structure comprising a plurality of tubular boom sections having respectively different diameters, and being concentrically nestable about a common displacement axis, and having helical tracks and roller assemblies through which adjacent tubular boom sections mutually engage one another for telescoping displacement along said common displacement axis, wherein a first tubular boom section has a helical track formed along an exterior tubular surface thereof, so as to be engageable by one or more rotational elements retained at an interior surface of a second tubular boom section having a diameter greater than that of said first tubular boom section, wherein adjacent ones of said concentrically nestable tubular boom sections are mutually engageable with one another by means of said helical tracks formed on outer cylindrical surfaces of relatively radially interior tubular boom sections, and associated rollers formed on inner surfaces of relatively radially exterior tubular boom sections and being arranged to ride along said helical tracks.

2. The telescoping boom structure according to claim 1, further including a drive motor coupled to rotationally drive said second tubular boom section, and wherein said one or more rotational elements are retained at said interior surface thereof about said common displacement axis, so as to cause said one or more rotational elements of said second tubular boom section to engage and rotate said helical track of said first tubular boom section, thereby causing displacement of said first tubular boom section relative to said second tubular boom section along said common displacement axis.

3. The telescoping boom structure according to claim 2, wherein said first tubular boom section further includes a stop element adjacent to a terminal portion of said helical track of said first tubular boom section, said stop element being operative to engage a rotational element of said second tubular boom section and prevent further rotation of said helical track of said first tubular boom section relative to said second tubular boom section.

4. The telescoping boom structure according to claim 3, wherein said stop element is formed in said helical track.

5. The telescoping boom structure according to claim 1, wherein a first tubular boom section has a helical track formed along an exterior tubular surface thereof, so as to be engageable by one or more rotational elements retained at an interior surface of a second tubular boom section having a diameter greater than that of said first tubular boom section.

6. The telescoping boom structure according to claim 5, wherein a third tubular boom section has a helical track formed along an exterior tubular surface thereof, so as to be engageable by one or more rotational elements retained at an interior surface of said first tubular boom section, which has a diameter greater than that of said first tubular boom section.

7. An expandable structure-deploying actuator mechanism comprising a plurality of concentrically nestable tubular boom sections, that are mutually engageable with one another by way of roller assemblies and helical tracks formed thereon, so that the tubular boom sections may expand telescopically along a deployment axis by means of a rotational drive actuator coupled to one of said tubular boom sections, wherein adjacent ones of said concentrically nestable tubular boom sections are mutually engageable with one another by means of a helical track formed on an outer cylindrical surface of a relatively radially interior tubular boom section, and associated rollers formed on an inner surface of a relatively radially exterior tubular boom section and being arranged to ride along said helical track.

8. The expandable structure-deploying actuator mechanism according to claim 7, wherein a radially outermost tubular boom section contains interior roller assemblies, but no outer helical track, while a radially innermost tubular boom section contains an outer helical track, but no interior roller assemblies.

9. A method of deploying a plurality of concentrically nestable cylindrically configured boom sections along an axis about which said boom sections are concentric, said method comprising the steps of:

(a) providing outer surfaces of said boom sections with helical tracks;

(b) providing interior surfaces of said boom sections with roller assemblies that are positioned to engage helical tracks of radially interiorly adjacent boom sections; and (c) imparting a rotational drive to a selected one of said concentrically nestable cylindrically configured boom sections, so as to cause a roller assembly of said selected boom section to engage a helical track of a radially interiorly adjacent boom section, and thereby cause linear displacement of another, radially interiorly adjacent boom section along said axis.

10. The method according to claim 9, wherein said selected one of said concentrically nestable cylindrically configured boom sections corresponds to a radially outermost one of said concentrically nestable cylindrically configured boom sections.

11. The method according to claim 9, wherein said radially interiorly adjacent boom section includes a stop element adjacent to a terminal portion of the helical track thereon, said stop element being operative to engage a roller assembly of said selected one of said concentrically nestable cylindrically configured boom sections.

12. The method according to claim 11, wherein said stop element is formed in said helical track.

* * * * *